US006468027B2

(12) United States Patent
Narisako et al.

(10) Patent No.: US 6,468,027 B2
(45) Date of Patent: Oct. 22, 2002

(54) FUEL PUMP FOR INTERNAL COMBUSTION ENGINE

(75) Inventors: Hideki Narisako, Kariya (JP); Yoshio Ebihara, Kariya (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 09/821,805

(22) Filed: Mar. 30, 2001

(65) Prior Publication Data

US 2001/0028844 A1 Oct. 11, 2001

(30) Foreign Application Priority Data

Mar. 31, 2000 (JP) ..... 2000-097570

(51) Int. Cl.[7] ..... F04D 5/00

(52) U.S. Cl. ..... 415/55.1; 415/203; 415/206; 415/55.2

(58) Field of Search ..... 415/55.1, 55.2, 415/55.3, 55.4, 55.5, 55.6, 55.7, 203, 206

(56) References Cited

U.S. PATENT DOCUMENTS 5,011,367 A 4/1991 Yoshida et al.

5,498,124 A 3/1996 Ito et al.

FOREIGN PATENT DOCUMENTS

JP 9-119390 5/1997

*Primary Examiner*—Edward K. Look
*Assistant Examiner*—Kimya N McCoy
(74) *Attorney, Agent, or Firm*—Nixon & Vanderhye PC

(57) ABSTRACT

A casing includes a C-shaped casing side pump groove along blades of an impeller. A casing cover also includes a casing cover side pump groove facing the casing side pump groove. The casing side pump groove and the casing cover side pump groove form a pump fluid passage. A gap is provided between an outer surface of the pump grooves and the impeller. Depth, and outer and inner diameters of a pump groove starts to gradually change from a fuel upstream side of a fuel outlet. The depth of the pump groove gradually decreases, the outer diameter of the pump groove gradually decreases to approach an outer diameter of the impeller, and the inner diameter of the pump groove gradually increases to approach the outer diameter of the impeller. The pump groove ends at a downstream side of the fuel outlet.

17 Claims, 4 Drawing Sheets

FUEL PUMP FOR INTERNAL COMBUSTION ENGINE

CROSS REFERENCE TO RELATED APPLICATION

This application is based on and incorporates herein by reference Japanese Patent Application Nos. 2000-97570 filed on Mar. 31, 2000, and 2001-95349 filed on Mar. 29, 2001.

BACKGROUND OF THE INVENTION

1. Field of the Invention

The present invention relates to a fuel pump for sucking a fuel from a fuel tank and discharging, suitable for use in an internal combustion engine.

2. Description of Related Art

FIG. 4 shows a conventional fuel pump having a disk-like impeller including blades at the outer periphery thereof. The impeller rotates to suck and discharge a fuel. An impeller 110 is rotatably provided between an upper housing 100 and a lower housing (not illustrated). The lower housing includes a fuel inlet at a position facing an inlet position 105 of the upper housing 100. The upper housing 100 includes an arc-shaped pump groove 101 along blades of the impeller 110 from the inlet position 105 to a fuel outlet 106. The lower housing also includes a pump groove facing the pump groove 101. Both pump grooves form a pump fluid passage 102.

However, in the conventional fuel pump, a cross sectional area of the pump groove sharply decreases at the fuel outlet, and the pump groove 101 ends at the fuel outlet 106. Thus, fuel held in a blade groove formed between each of adjacent blades of the impeller 110 collides with a wall surface 107 of the upper housing 100, which is positioned at the end of the pump fluid passage 102 and forms the fuel outlet 106, thereby introducing a noise of which frequency is expressed by (the number of impellers)×(motor rotation number).

U.S. Pat. No. 5,011,367 discloses a fuel pump in which a pump groove crosses an impeller, and the wall surface of the pump groove is rounded to reduce a noise. JP-A-9-119390 discloses a fuel pump in which a gap between the outer periphery of an impeller and a circumferential wall surface facing the outer periphery of the impeller gradually decreases to reduce a noise.

However, in both U.S. Pat. No. 5,011,367 and JP-A-9-119390, a pump groove ends at a fuel outlet. Thus, even when the pump groove is rounded, or the gap between the outer periphery of the impeller and the circumferential wall is gradually decreased, fuel held in the blade groove might collide with a wall surface forming the fuel outlet to introduce the noise.

U.S. Pat. No. 5,498,124 discloses a fuel pump in which a damping portion is formed at the downstream side of discharge port. The damper portion includes a slanting wall surface going away from the outer periphery of an impeller in the rotating direction of the impeller.

SUMMARY OF THE INVENTION

An object of the present invention is to reduce a noise in a fuel pump.

According to a first aspect of the present invention, depth, and outer and inner diameters of a pump groove starts to gradually change from a fuel upstream side of a fuel outlet. The depth of the pump groove gradually decreases, the outer diameter of the pump groove gradually decreases to approach an outer diameter of the impeller, and the inner diameter of the pump groove gradually increases to approach the outer diameter of the impeller. The pump groove ends at a downstream side of the fuel outlet.

Thus, the fuel held in a blade groove passes through the fuel outlet, and does not collide with a wall surface of the fuel outlet, thereby reducing a noise at the fuel outlet.

According to a second aspect of the present invention, a buffer chamber is formed at a fuel downstream side of the fuel outlet in a rotating direction of the impeller. The buffer chamber communicates with the pump groove, and a cross sectional area thereof decreases in the rotating direction of the impeller. Inner and outer walls of the buffer chamber gradually approach the outer periphery of the impeller in the rotating direction of the impeller. An end point of the buffer chamber is arranged at a position substantially corresponding to the outer diameter of the impeller.

Thus, when the impeller passes through a fuel downstream side end of the fuel outlet while providing a slight gap therebetween, amount of the fuel around a fluid passage end, which transmits the noise, is reduced, thereby suppressing the noise. The fuel is pushed out from the buffer chamber to be discharged through the fuel outlet.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS (First Embodiment)

Figure 2:
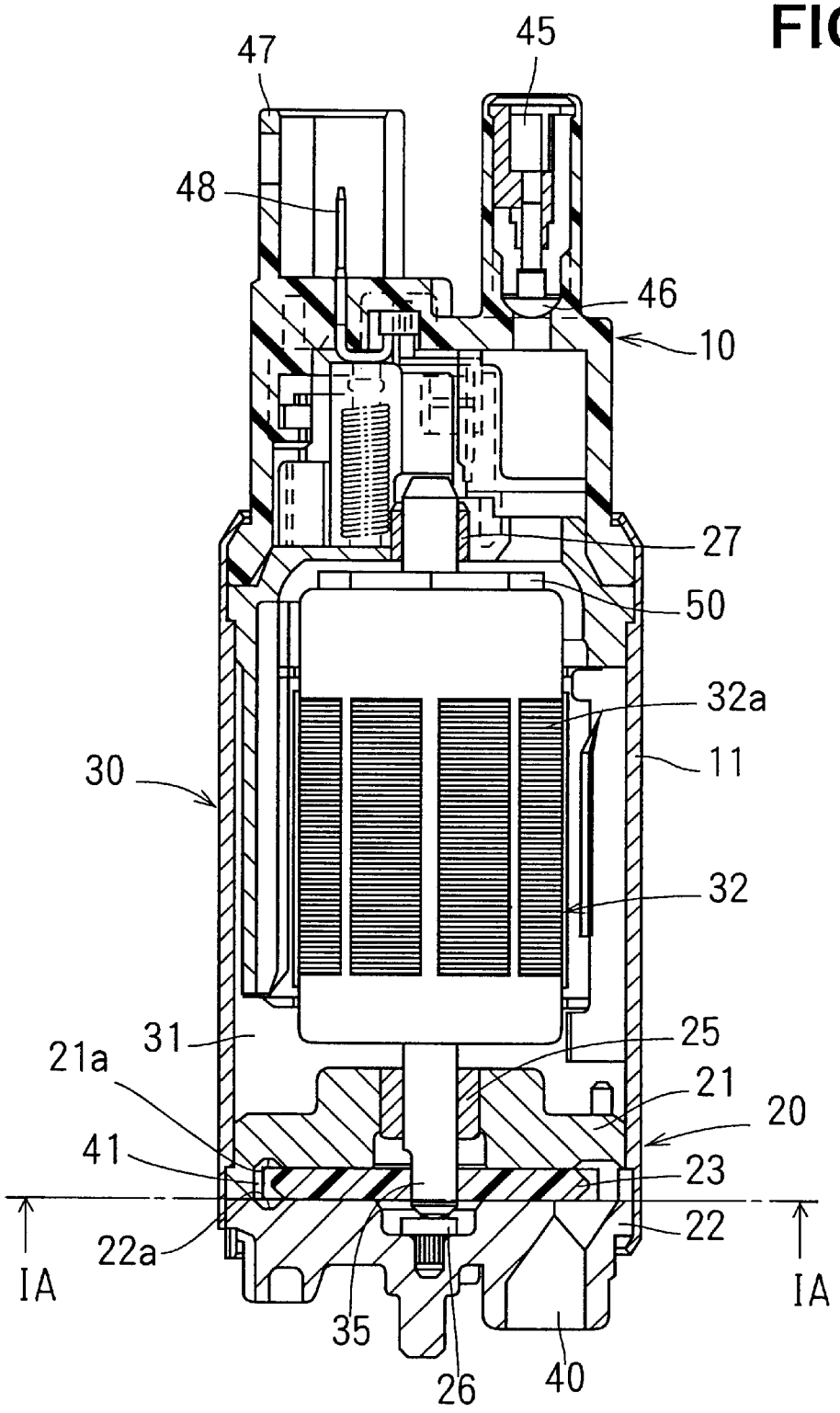
FIG. 2 is a cross-sectional view showing a fuel pump in the present embodiment.

FIG. 2 is a cross-sectional view showing a fuel pump 10 in the present embodiment. The fuel pump 10 is used for a fuel supply system in an electronic fuel injection system, and is provided in a vehicle fuel tank. The fuel pump 10 sucks the fuel from the fuel tank and supplies it into an engine.

The fuel pump 10 includes a pump section 20 and a motor section 30 operating the pump section 20. The motor section 30 includes a DC motor having a brush. A permanent magnet is disposed like a ring in a cylindrical housing 11, and an armature 32 is arranged inside the permanent magnet concentrically therewith.

The pump section 20 includes a casing 21, a casing cover 22 and an impeller 23. The casing 21 and the casing cover 22 forms a fluid passage therebetween, and the impeller 23 is rotatably provided in the fluid passage. The impeller 23 includes a plurality of blades 23*a* and blade grooves 23*b*. The blade groove 23*b* is formed between each of the adjacent blades 23*a*. The casing 21 and the casing cover 22 are made of aluminum die-cast. The casing 21 is press-inserted into the lower end of the housing 11, and a bearing 25 is provided at the center thereof. The casing cover 22 covers the casing 21, and is mechanically fixed to the housing 11. A thrust bearing 26 is press-inserted into the center of the casing cover 22. The bearing 25 radially rotatably supports the lower end of a rotating shaft 35 of the armature 32, and the thrust bearing 26 axially supports the lower end of the rotating shaft 35. A bearing 27 radially rotatably supports the upper end of the rotating shaft 35.

Figure 1A:
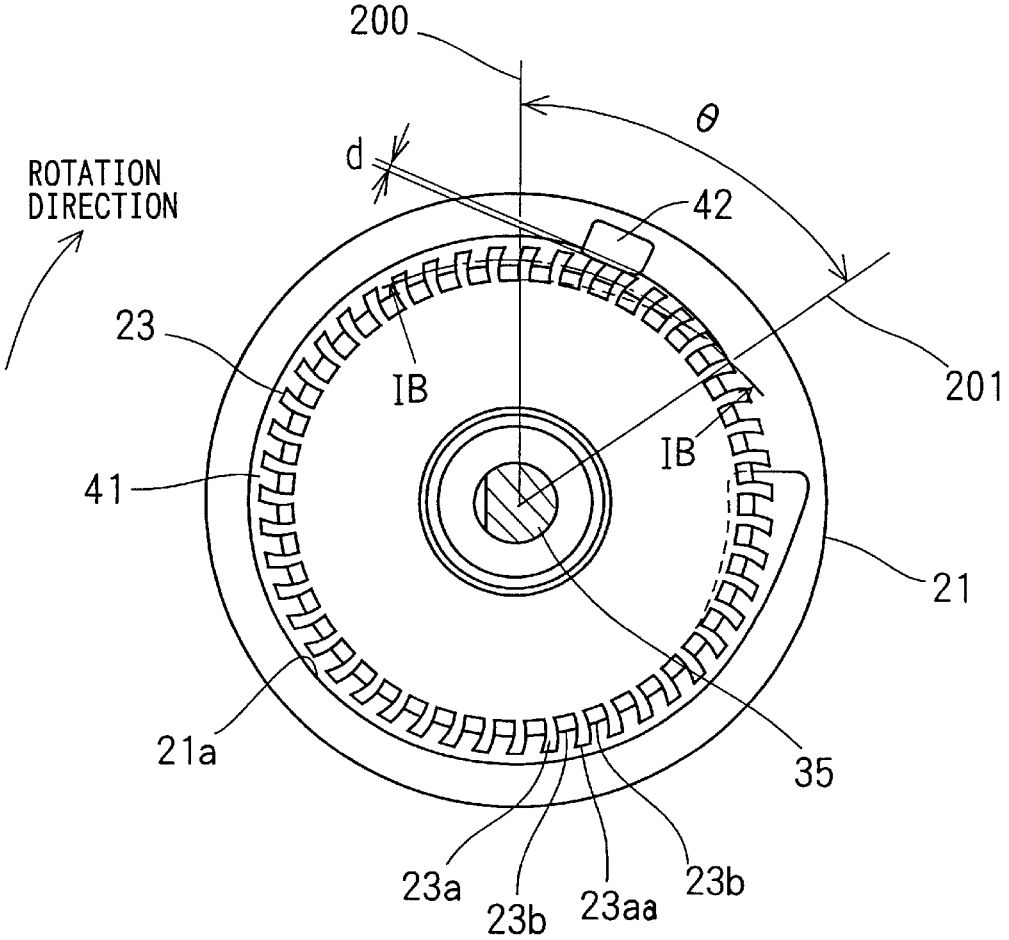
FIG. 1A is a cross-sectional view taken along line IA—IA in FIG. 2.
Figure 1B:
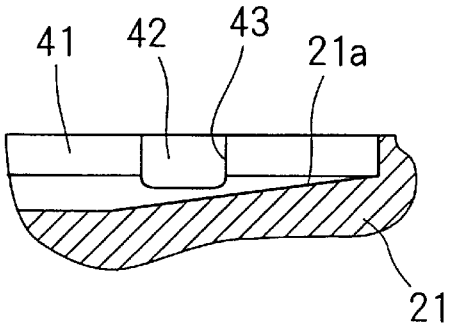
FIG. 1B is a cross-sectional view taken along line IB—IB in FIG. 1A.
Figure 5:
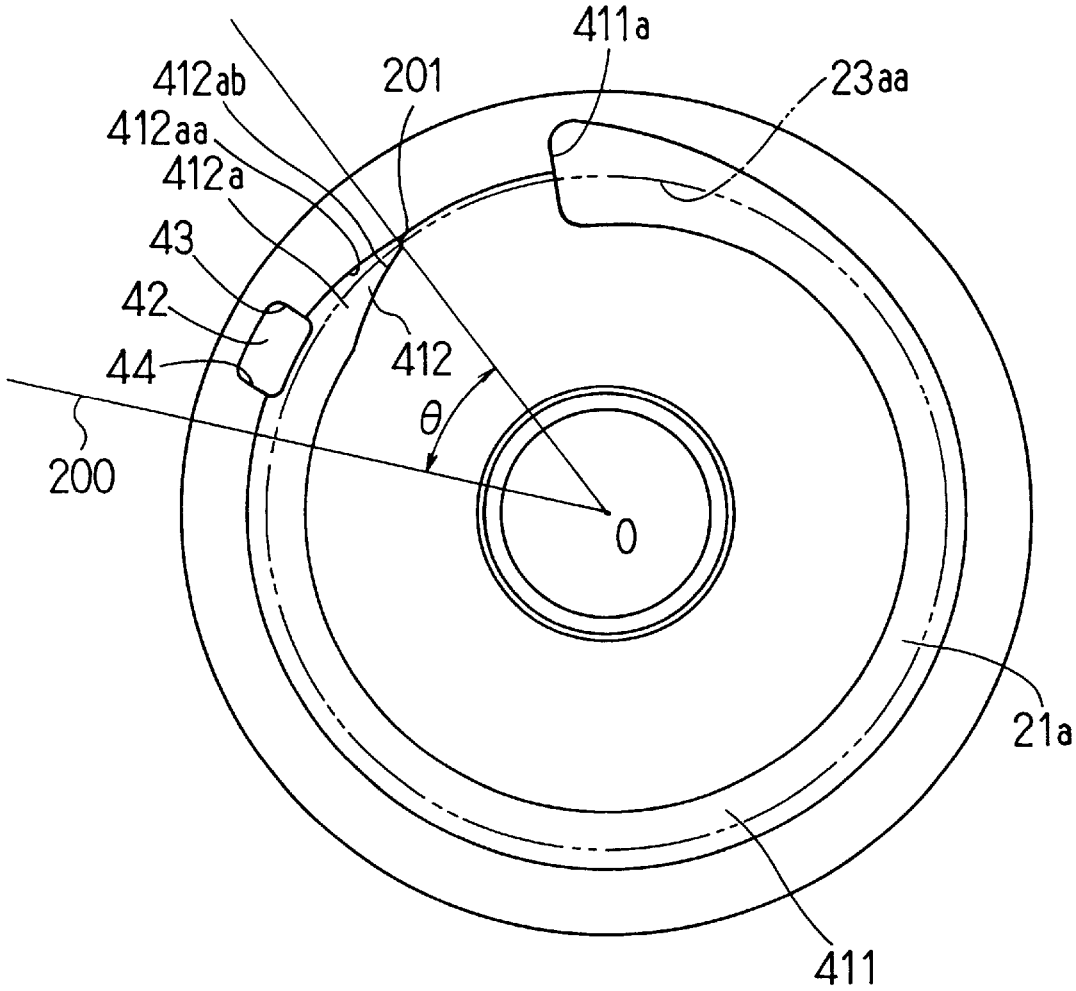
FIG. 5 is a bottom view showing a casing of the fuel pump.

A fuel inlet 40 is formed within the casing cover 22. When the impeller 23 rotates, the fuel in the fuel tank is introduced into a pump fluid passage 41. As shown in FIG. 5, the pump fluid passage 41 defines a pressure increasing passage 411 and a buffer chamber 412. The pressure increasing passage 411 starts from an inlet side end surface 411*a,* and extends to an upstream side end 44 of a fuel outlet 42. When the impeller 23 rotates, pressure of the fuel introduced into the pump fluid passage 41 is increased in the pressure increasing passage 411. After that, the fuel is discharged into a fuel chamber 31 of the motor section 30 through the fuel outlet 42 (see FIG. 1) formed within the casing 21. As shown in FIG. 1, a C-shaped pump groove 21*a* is formed along the blade 23*a* of the impeller 23, in the casing 21. As shown in FIG. 2, a pump groove 22*a* is formed to face the pump groove 21*a,* in the casing cover 22. Both pump grooves 21*a* and 21*b* form the pump fluid passage 41. The pump grooves 21*a,* 22*a* extend in a rotational direction of the impeller 23 through the fuel outlet 42 and end at an end position 201. At a downstream side end 43 of the fuel outlet 42, there is a gap "d" between the outer periphery of the pump grooves 21*a,* 22*a* and the blades 23*a* of the impeller 23. The fuel held in the blade groove 23*b* passes through flows through the gap "d" to pass through the fuel outlet 42, and pushed out from the buffer chamber 412 formed between the fuel outlet 42 and the end position 201 to be discharged through the fuel outlet 42.

As shown in FIG. 2, the armature 32 is rotatably provided in the motor section 30, and a coil is wound around a core 32*a* thereof. A commutator 50 is formed in a disc, and is provided above the armature 32. An electric current is supplied to the coil through a terminal 48 built in a connector 47, a brush (not illustrated), and the commutator 50. When the armature 32 rotates due to the electric current, the rotating shaft 35 and the impeller 23 rotate together. When the impeller 23 rotates, the fuel is introduced into the pump fluid passage 41 through the fuel inlet 40. The fuel receives kinetic energy from each blade 23*a,* passes through the pump fluid passage 41 and the fuel outlet 42, and is discharged into the fuel chamber 31. After that, the fuel passes around the armature 32, and is discharged out of the fuel pump through a discharge port 45. A check valve 46 is provided in the discharge port 45, and prevents the flow-back of the fuel discharged through the discharge port 45.

The buffer chamber 412 is formed of a casing side groove 412*a,* as shown in FIG. 5, and a casing cover side groove. Changes of depths and outer and inner diameters of the casing cover side groove are the same as of the casing side groove 412*a*.

As shown in FIG. 5, the buffer chamber 412 is formed of a casing side groove 412*a* and a casing cover side groove 412*b*. Changes of depths and outer and inner diameters of the casing cover side groove 412*b* are the same as of the casing side groove 412*a*.

Depth, outer and inner diameters of the pump groove 21*a* starts to change, from a start position 200, to gradually reduce the cross sectional area thereof. The start position 200 is located at the fuel-flow upstream side of the fuel outlet 42. The pump groove 21*a* finally connects with the casing side groove 412*a,* and changes of the depth, outer and inner diameters of the casing side groove 412*a* continue to the end position 201. The casing side groove 412*a* starts from the downstream side end 43 of the fuel outlet 42, and extends to the end position 201. The casing side groove 412*a* closes at the end position 201. The depth of the pump groove 21*a* gradually decreases from the start position 200, and the depth of the casing side groove 412*a* also gradually decreases and becomes approximately zero at the end position 201. The outer diameter of the pump groove 21*a,* which is a distance between outer wall 412*aa* and center O, starts to gradually decrease from the start position 200, and the outer diameter of the casing side groove 412*a* also gradually decreases and finally becomes approximately same as the outer diameter (two-dotted chain line in FIG. 5) of the impeller 23 at the end position 201. The inner diameter of the pump groove 21*a,* which is a distance between inner wall 412*ab* and the center O, starts to gradually increase from the start position 200, and the inner diameter of the casing side groove 412*a* also gradually increases and finally becomes approximately equal to the outer diameter of the impeller 23 at the end position 201.

As described above, the casing side groove 412*a* and the casing cover side groove 412*b* extend to the end position 201 while gradually decreasing the cross-sectional areas thereof, and form the buffer chamber 412. In the present embodiment, the end position 201 is small-rounded.

At the downstream side end 43 of the fuel outlet 42, there is a gap "d" between the outer periphery of the pump grooves 21*a,* 22*a* and the blades 23*a* of the impeller 23. The gap "d" is within a range of 0.2–3.4 mm ($0.2 \leqq d \leqq 3.4$). When the gap "d" is less than 0.2 mm, although the pump groove 21*a* passes through the fuel outlet 42, the distance between the blade 23*a* and the outer periphery surface of the pump groove 21*a* is too small. Thus, the fuel held in the blade 23*b* collides with the downstream side end 43 of the fuel outlet 42, thereby causing a noise. If the gap "d" is more than 3.4 mm, when the depth, outer and inner diameters of the pump groove 21*a* gradually change, the pump groove 21*a* reaches the fuel inlet 40. Thus, a portion between the fuel inlet 40 and the fuel outlet 42 cannot be sealed. Here, when the depth, outer and inner diameters of the pump groove 21*a* sharply change, the pump groove 21*a* does not reach the fuel inlet 40. However, since the pump groove 21*a* sharply approaches the impeller 23 around the end of the pump groove 21*a,* the fuel pressure in the pump fluid passage 41 abruptly rises. Thus although a noise does not arise at the fuel outlet 42, a noise might arise at the end position 201 of the pump groove 21*a*.

In the present embodiment, since the gap "d" is set within the range of 0.2–3.4, the pump groove 21*a* does not reach the fuel inlet 40 and the noise is reduced at the end position 201 of the pump groove 21*a*.

Here, an angle θ (degree) between the start position 200 and the end position 201 is within a range of 10–60 ($10 \leqq \theta \leqq 60$). When the angle θ is less than 10°, depth, since outer and inner diameters of the pump groove 21*a* sharply change, although a noise does not arise at the fuel outlet 42, a noise might arise at the end position 201 of the pump groove 21*a*. If the angle θ is more than 60, when the depth, outer and inner diameters of the pump groove 21*a* gradually change such that the noise is not introduced at the end position 201, the pump groove 21*a* might reach the fuel inlet 40. In the present embodiment, since the angle θ is set within the range of 10–60 (degrees), the pump groove 21*a* does not reach the fuel inlet 40 and the noise is reduced at the end position 201 of the pump groove 21*a*.

The fuel held in the blade grove 23*b* passes through the fuel outlet 42, and does not collide with the downstream side end 43 of the fuel outlet 42. Further, since the depth, outer and inner diameters of the pump grooves 21*a,* 22*a* gradually change, the fuel pressure does not abruptly rise around the end position 201, thereby reducing noise at the fuel outlet 42 and around the end position 201 of the fuel fluid passage 41.

The impeller 23 raises the fuel pressure in the pressure increasing passage 411, and discharges the fuel from the fuel outlet 42. In the buffer chamber 412, some fuel is stored, and the fuel of which pressure is increased collides with the stored fuel. Thus, a pump noise is reduced in comparison with prior art in which the fuel directly collides with a wall. Further, the outer and inner walls 412*aa,* 412*ab* of the buffer chamber 412 gradually approach the outer periphery 23*aa* of the impeller 23 along the rotational direction of the impeller 23, so that timing when the pressure-increased fuel collides with the walls 412*aa,* 412*ab* is off-set, thereby reducing the noise. The end position 201 is small-rounded, so that the noise is effectively reduced. Further, the outer wall 412*aa* and the inner wall 412*ab* do not cross up to the end position 201, so that the outer periphery 23*aa* of the impeller 23 passes through the end position 201. Thus, even if a vibration arises when the impeller 23 passes through the end position 201 with a slight gap, since there is no fuel at the advanced side of the end position 201 in the rotational direction, the vibration is not transmitted. Thereby, the noise is further reduced.

Here, the impeller 23 may have a ring at the outer periphery thereof. In this case, the outer periphery of the impeller 23 means the outer periphery of the ring.

Figure 3:
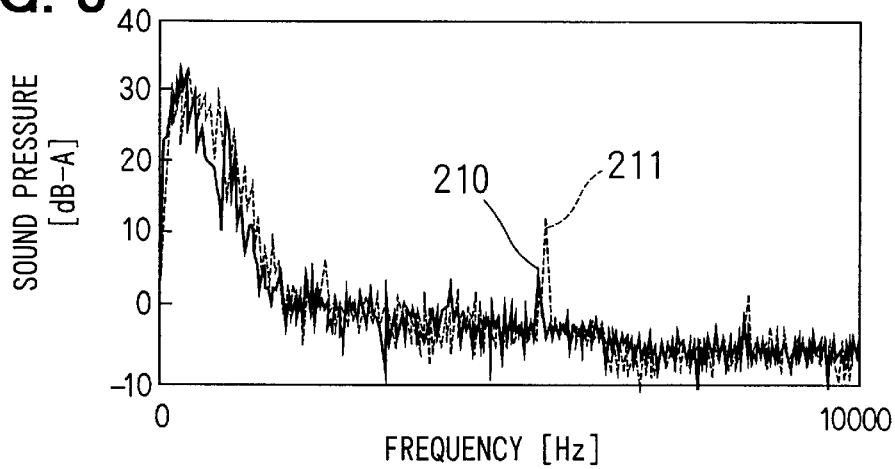
FIG. 3 is a graph showing relationships between frequency and sound pressure in the fuel pump of the present embodiment and in the conventional fuel pump.
Figure 4A:
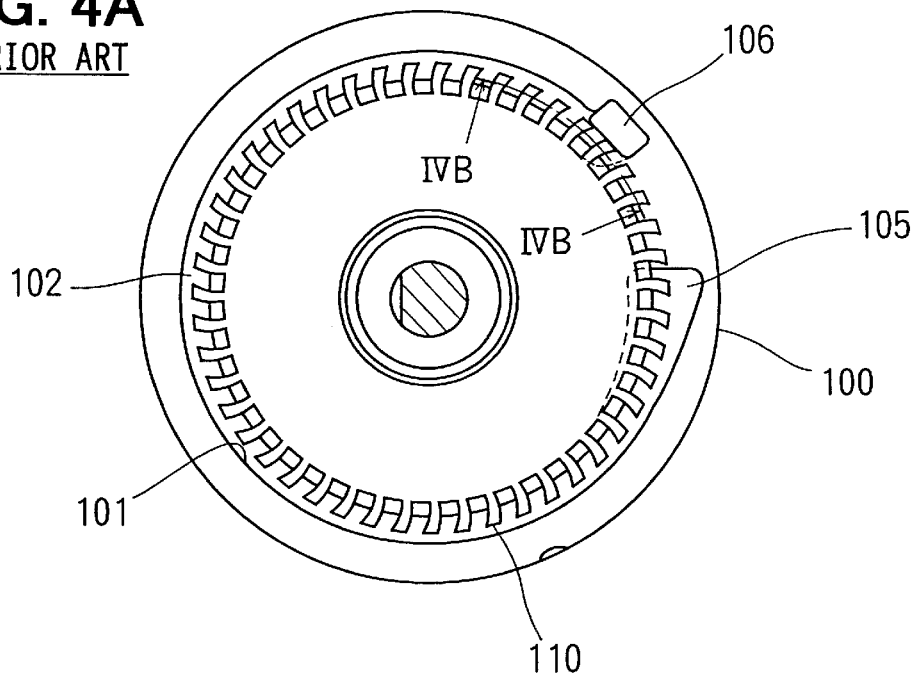
FIG. 4A PRIOR ART
FIG. 4A is a plan view showing an impeller and a pump fluid in the prior art fuel pump.
Figure 4B:
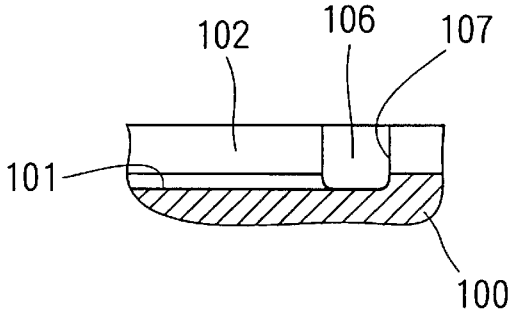
FIG. 4B PRIOR ART
FIG. 4B is an enlarged cross-sectional view showing a fuel outlet in the prior art fuel pump.

FIG. 3 is a graph showing relationships between frequency and sound pressure in the fuel pump 10 of the present embodiment and in the conventional fuel pump shown in FIG. 4. A slid line 210 indicates a characteristic of the present embodiment, and a broken line 211 indicates a characteristic of the prior art. In the prior art, as indicated by the broken line 211, a sound pressure peak arises when the frequency is within 5000–6000 Hz. Contrary to this, in the present embodiment, as indicated by the solid line 210, the sound pressure peak amount is reduced in comparison with the prior art.

What is claimed is:

1. A fuel pump comprising:

an impeller having a plurality of blades at an outer periphery thereof; and a casing rotatably containing said impeller therein, said casing including a pump groove forming an arc-shaped pump fluid passage along said blades, said casing including a fuel inlet and a fuel outlet communicating with said pump fluid passage, wherein said impeller rotates to introduce fuel into said pump fluid passage through said fuel inlet and discharge the fuel through the fuel outlet, outer and inner diameters of said pump groove start to gradually change from a fuel upstream side of said fuel outlet, in a rotating direction of said impeller, the gradually changing outer diameter of said pump groove and the gradually changing inner diameter of said pump groove define therebetween a buffer chamber in the pump groove, said pump groove ends at a downstream side of said fuel outlet, and the cross-sectional area of the buffer chamber is gradually decreased from the fuel upstream side of said fuel outlet along the rotating direction of the impeller.

2. The fuel pump according to claim 1, wherein a gap "d" is provided between an outer periphery of said pump groove and said blades of said impeller, at a downstream side end of said fuel outlet, and the gap "d" is within a range of 0.2 mm–3.4 mm (0.2 mm≦d≦3.4 mm).

3. The fuel pump according to claim 1, wherein an angle θ between a start position where the outer and inner diameters of said pump groove start to change and an end position where said pump groove ends is within a range of 10°–60° (10°≦θ≦60°).

4. The fuel pump according to claim 1, wherein inner and outer walls of said buffer chamber gradually approach the outer periphery of said impeller in the rotating direction of said impeller, and an end point of said buffer chamber is arranged at a position substantially corresponding to an outer surface of said impeller.

5. The fuel pump according to claim 1, wherein the fuel outlet has an opening that extends over the pump groove and a radial outside area of the pump groove.

6. The fuel pump according to claim 1, wherein the fuel outlet has a substantially rectangular opening.

7. The fuel pump according to claim 1, wherein the inner diameter of said pump groove gradually increases in the rotating direction of said impeller from a fuel upstream side of said fuel outlet, to approach the outer diameter of said impeller.

8. The fuel pump according to claim 1, wherein the depth of the pump groove is gradually decreased in the rotating direction of the impeller from the fuel upstream side of the fuel outlet, the depth being gradually decreased in a straight-line manner.

9. The fuel pump according to claim 8, wherein an outer diameter of said pump groove gradually decreases in the rotating direction of said impeller from a fuel upstream side of said fuel outlet, to approach an outer diameter of said impeller.

10. The fuel pump according to claim 8, wherein an angle θ between a start position where the depth of said pump groove starts to change and an end position where said pump groove ends is within a range of 10°–60° (10°≦θ≦60°).

11. A fuel pump comprising:

an impeller having a plurality of blades at an outer periphery thereof; and a casing rotatably containing said impeller therein, said casing including a pump groove forming an arc-shaped pump fluid passage along said blades, said casing including a fuel inlet and a fuel outlet communicating with said pump fluid passage, wherein said impeller rotates to introduce fuel into said pump fluid passage through said fuel inlet and discharge the fuel through the fuel outlet, said pump groove ends at a downstream side of said fuel outlet, and a depth of the pump groove is decreased in a rotating direction of the impeller from the fuel upstream side of the fuel outlet, the depth being decreased in a straight-line manner.

12. A fuel pump comprising:

an impeller having a plurality of blades circumferentially arranged to define a plurality of axially opened blade grooves therebetween; and a casing rotatably containing said impeller therein, said casing having a pump groove extending along the blades, a fuel inlet located on an upstream region of the pump groove, and a fuel outlet located on a relatively downstream region of the pump groove, wherein the pump groove has a constant groove portion located downstream from the fuel inlet, the constant groove having substantially constant cross-sectional area along a rotating direction of the impeller, and a narrowing groove within which the fuel outlet is located, the narrowing groove having cross-sectional area that gradually narrows along the rotating direction from the constant groove portion and terminates at a downstream side of the fuel outlet, the cross-sectional area of the narrowing groove being continuously and smoothly narrowed without significant change of narrowing rate in the rotating direction over an entire circumferential length of the narrowing groove portion except at the fuel outlet.

13. The fuel pump according to claim 12, wherein the constant groove portion and the narrowing groove portion are defined by an outer wall, an inner wall, and a bottom wall, and wherein the outer wall and the inner wall approach each other in the rotating direction from the upstream side of the fuel outlet to narrow and terminate the narrowing groove portion.

14. The fuel pump according to claim 13, wherein the bottom wall defines a depth of the pump groove which is smoothly decreased in the rotating direction from the upstream side of the fuel outlet to the end of the narrowing groove portion.

15. A fuel pump according to claim 14, wherein the outer wall and the inner wall are provided by perpendicular walls that are perpendicular to the impeller.

16. The fuel pump according to claim 12, wherein the constant groove portion and the narrowing groove portion are defined by an outer wall, an inner wall, and a bottom wall, and wherein the bottom wall defines a depth of the pump groove which is smoothly decreased in the rotating direction from the upstream side of the fuel outlet to the end of the narrowing groove portion.

17. A fuel pump according to claim 12, wherein the narrowing groove portion is defined by surfaces which are smooth along the rotating direction except at an opening in the fuel outlet.

* * * * *